US006095018A

United States Patent [19]

Schuster

[11] Patent Number: 6,095,018

[45] Date of Patent: Aug. 1, 2000

[54] ROTARY HAND TOOL WITH A CRANK ARM INCORPORATED INTO ITS HANDLE

[76] Inventor: Paul Scott Schuster, 5245 Oak Forest Dr., Racine, Wis. 53406

[21] Appl. No.: 09/036,620

[22] Filed: Mar. 8, 1998

Related U.S. Application Data

[60] Provisional application No. 60/040,351, Mar. 8, 1997.

[51] Int. Cl.[7] ..... B25B 23/16

[52] U.S. Cl. ..... 81/177.5; 81/177.6; 81/489; 81/35

[58] Field of Search ..... 81/177.5, 177.6, 81/489, 35

[56] References Cited

U.S. PATENT DOCUMENTS

| | | |
|---|---|---|
| 4,000,767 | 1/1977 | Geng . |
| 4,825,734 | 5/1989 | Schwalbe . |
| 5,003,850 | 4/1991 | Harkins . |
| 5,520,073 | 5/1996 | Bakula . |
| 5,586,475 | 12/1996 | Wenner . |
| 5,590,575 | 1/1997 | Ludy . |

*Primary Examiner*—Timothy V. Eley
*Assistant Examiner*—Willie Berry, Jr.

[57] ABSTRACT

A rotary driver providing continuous uninterrupted rotation, which allows the user to install rotary fasteners without the tedious and potentially harmful long term effects of twisting the wrist. The tool comprises a handle of the size and shape to comfortably fit in a hand of a operator, connected to a tool shank which extends axially therefrom. The shank carries a tool tip at its distal end. The handle also incorporates a lever arm that extends outward from the longitudinal axis of the shank. A free spinning lever arm handle is mounted at its extended end creating a crank arm assembly for the rotary driver. This assembly is attached to the handle by a pivot at its end. The assembly can then be rotated from a stored position in a handle pocket to a extended working position. When the crank arm assembly is in the stored position, the rotary driver appears and functions like a traditional screw-driver.

8 Claims, 4 Drawing Sheets

ROTARY HAND TOOL WITH A CRANK ARM INCORPORATED INTO ITS HANDLE

This application claims benefit of Provisional Appl. 60/040,351 filed Mar. 8, 1997.

BACKGROUND—FIELD OF THE INVENTION

The present invention relates to hand tools such as screwdrivers, bit-drivers, nut-drivers, and ratcheting screwdrivers which are used for the manual turning of many different types of rotary fasteners

BACKGROUND—DESCRIPTION OF PRIOR ART

There are many different types of screwdrivers today to aid the operator in turning the many different styles and sizes of rotary fasteners. However, most require rotation of the operators wrist to perform the fastening task. Some examples of the different types of screwdrivers to aid the operator in fastening are shown in the following U.S. patents:

U.S. Pat. No. 5,590,575 to Ludy discloses a device that provides a lever handle to benefit the user when encountering high torque situations. This screwdriver type requires the operator to twist the tool in order to drive the fastener; resulting in the tedious turning of the operators wrists during the fastening process. Also, the lever is protruding above the grip surface which may lead to further fatigue of the user. A similar lever type screwdriver is disclosed in U.S. Pat. No. 4,000,767 to Geng. This device shows a lever located at the base of the handle which provides the rotational leverage. Another similar device is shown in U.S. Pat. No. 4,825,734 to Schwalbe. This device provides leverage in a different configuration, but still requires twisting of the operators wrist to drive a fastener as seen with the traditional screwdriver.

U.S. Pat. No. 5,520,073 to Bakula discloses a device which combines the lever type handle with a reversible ratcheting mechanism. The lever handle is beneficial in high torque situations as stated above; however, the ratcheting mechanism requires the operator to twist their wrist back and forth in order to drive the fastener. This intermittent rotation can lead to wrist fatigue over a long period of time. This device also requires the user to rotate a spinner attached to the tool shank when encountering low torque situations where the ratcheting mechanism will not function properly.

U.S. Pat. No. 5,586,475 to Wenner discloses a device which also combines the benefits of a lever arm with a ratcheting mechanism. The lever handle is beneficial in high torque situations as stated above; however, the ratcheting mechanism requires the operator to twist their wrist back and forth in order to drive the fastener. This device also incorporates a sleeve around the tool shank. Combined with finger holes in the extension handle, this tool can be rotated by a finger in lower torque situations to drive a fastener. The main disadvantage of this tool is it can not be used in all the locations and situations a standard screwdriver can. Still another disadvantage is that it is constructed with many different parts that would be costly to manufacture.

U.S. Pat. No. 5,003,850 to Harkins discloses a traditional looking screwdriver type tool with a sleeve positioned on the shank that contacts a bearing surface on the bit. This tool allows the operators hands to provide twisting and longitudinal force toward the fastener separately. The main disadvantage of this tool is again the twisting of the operators wrist during the fastening process.

OBJECTS AND ADVANTAGES

Accordingly, several objects and advantages of my invention are:

(a) to provide a screwdriver that provides the operator with high speed fastening by providing continuous uninterrupted rotation of the tool. This invention can rotate a fastener at speeds up to 180 RPM, depending upon the rotational torque of the fastener being driven.

(b) to provide a screwdriver that reduces the tedious turning of the operators wrists during the fastening process as found in using ratcheting or traditional type screwdrivers. This twisting can eventually lead to carpal tunnel syndrome.

(c) to provide a screwdriver that has an operating advantage over the traditional screwdriver.

(d) to provide a screwdriver that provides the user with high speed fastening, tightening torque, and increased driving force; all incorporated into a traditional looking and functional screwdriver type hand tool providing normal driving operation when desired.

(e) to provide an inexpensive and relatively simple design to accomplish said objectives, which is flexible enough to be incorporated into a wide variety of screwdriver types.

Further objects and advantages of my rotary driver will become apparent from a consideration of the drawings and ensuing descriptions.

LIST OF REFERENCE NUMERALS

Figure 3:
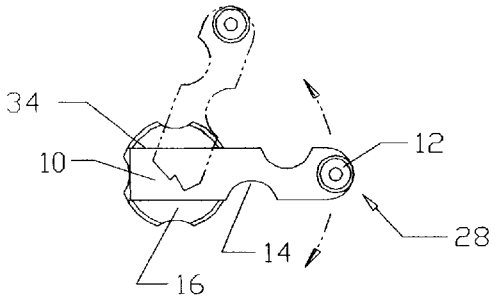
FIG. 3 shows the rotary driver from the top view showing the rotation of the tool with the crank arm assembly about the tools longitudinal axis.

10 Lever arm
12 Lever arm handle
14 Finger notch
16 Handle
18 Bit socket
20 Bearing stop
22 Secondary handle
24 Tool Shank
26 Tool tip
28 Crank arm assembly
30 Pivot
32 Handle pocket
34 Handle detent
36 Handle spinner pocket
38 Screwdriver
40 Tool bit
42 Notch

SUMMARY

The principal object of the rotary driver is to provide uninterrupted continuous rotation when driving rotary fasteners, without the tedious and potentially harmful long term effects of twisting the operators wrist, as seen with carpal tunnel syndrome.

When using the common screwdriver, the operator must twist the tool as far as physically possible while applying a longitudinal force towards the fastener, then release their grip on the tool handle while holding the tool in the new position with their other hand, un-twist the wrist and re-grip the tool; repeatedly until the fastener is installed.

Similarly, in ratcheting screwdrivers, the operator's wrist must twist the tool back and forth while applying a longitudinal force towards the fastener until the fastener is installed. The ratcheting type hand tools also do not work well when there is not enough torque to let the ratcheting mechanism function properly, requiring the operator to turn the fastener or tool shank with their fingers by methods including knurled shank sections.

The rotary driver accomplishes this objective by providing a turning mechanism that replaces the twisting of the wrist (associated with most screwdrivers) with rotation of the forearm. The different muscle groups used in rotating a screwdriver as compared with the rotary driver can be clearly illustrated by the following example: Compare sharpening a pencil with a hand held twist type verses the style having a crank arm spinning a cutting mechanism. The later is much faster to use, and doesn't require twisting of the wrist to perform the sharpening. With this in mind, it is clear to see how beneficial the rotary driver can be in a world full of rotary fasteners.

DESCRIPTION

Figure 1:
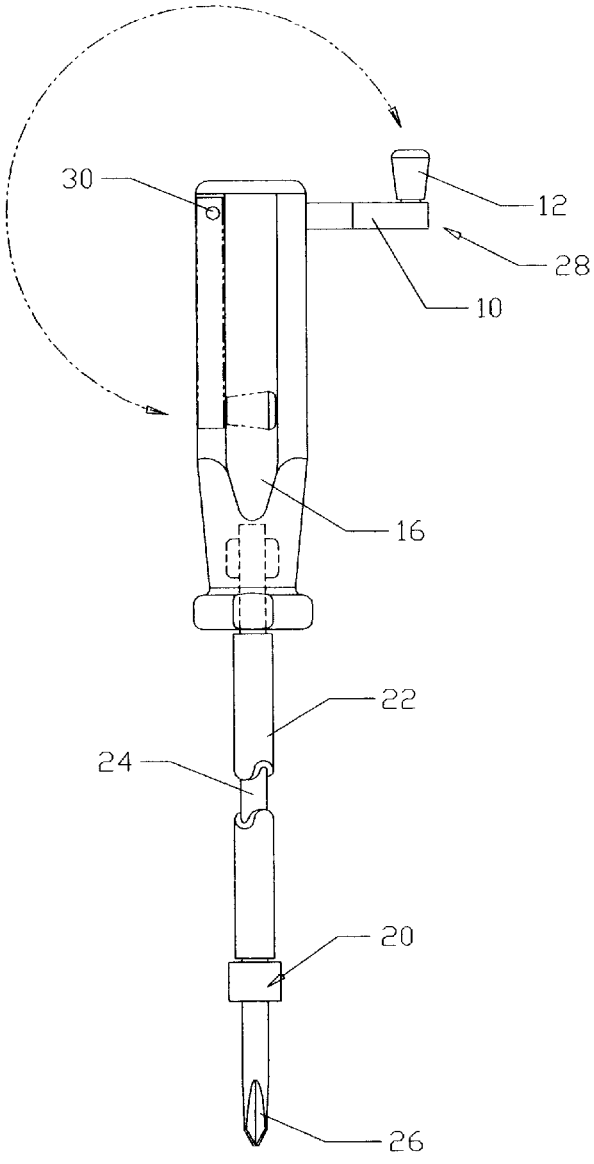
FIG. 1 shows a side view of the rotary driver showing the crank arm assembly in both the working and stored positions.
Figure 4:
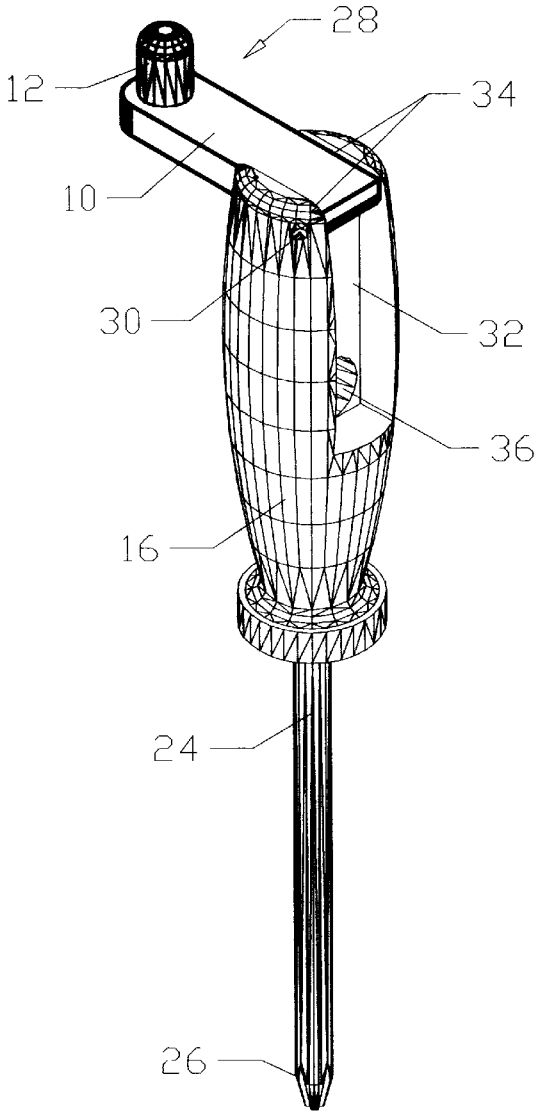
FIGS. 4 & 6 show embodiments of the rotary driver with the crank arm assembly in the stored position.
Figure 5:
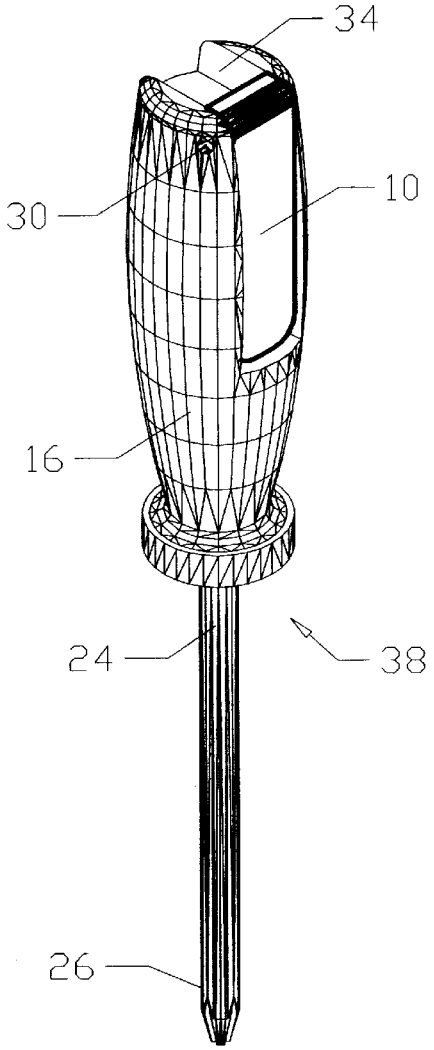
FIGS. 5 & 7 show embodiments of the rotary driver with the crank arm assembly in the working position.

A typical embodiment of the rotary driver is shown in FIGS. 4 & 5. A handle 16 of the size and shape to comfortably fit in a hand of a operator, is connected coaxial at its shaft end to a cylindrical shaped tool shank 24 which extends axially therefrom. The shank 24 carries a tool tip 26 at its distal end which is intended to couple with rotary fasteners. While the tip 26 is shown as a Phillips head screw driving tip, it will be appreciated that many other types of tips could be used. The handle 16 incorporates a lever arm 10 that extends outward from the longitudinal axis of shank 24. A free spinning lever arm handle 12 is mounted at its extended end creating a crank arm assembly 28 for the rotary driver. The assembly 28 is attached to handle 16 by a pivot 30 at its other end. Assembly 28 can then be rotated from a stored position in the handle pocket 32 (FIG. 5) to a working position (FIG. 4) as illustrated in FIG. 1. A circular finger notch 14 is formed into the extended sides of arm 10 to accommodate a finger. Pocket 32 also has a handle spinner pocket 36 to provide storage for handle 12. Assembly 28 is detented in the working position by the handle detent 34. When assembly 28 is in the stored position (FIG. 5), the rotary driver appears and functions like a traditional screwdriver 38.

Additional embodiments are shown in FIGS. 1, 2, 6, 7, 8 & 9. In each case they all feature the structure described in the typical embodiment above. The location and design of a secondary handle 22 and a bearing stop 20 differentiate the embodiments.

Figure 2:
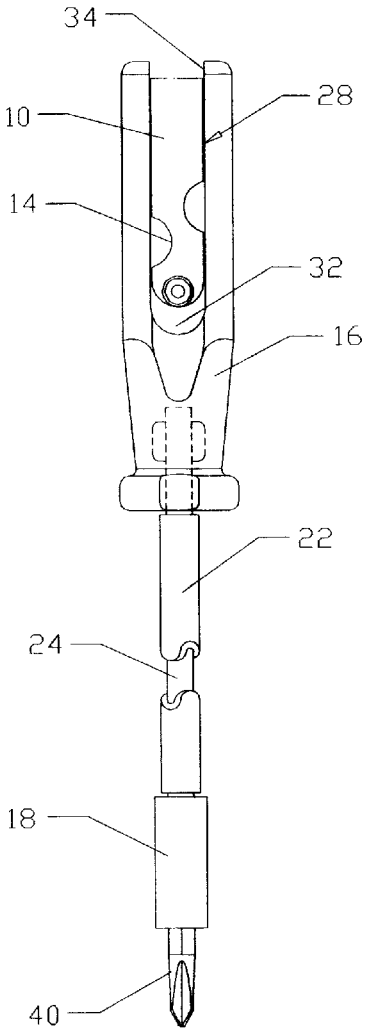
FIG. 2 shows the rotary driver incorporated into a bit-driver style screwdriver with the crank arm assembly in the stored position.

In FIGS. 1 & 2, a tube shaped secondary handle 22 having a cylindrical inner bearing surface and a bearing surface on each end, is mounted coaxial with shank 24. The inner bearing surface of handle 22 is in contact with the cylindrical outer surface of shank 24. Therefore, handle 22 can freely rotate axially about shank 24, and freely slide along the longitudinal axis of shank 24. A bearing stop 20 is rigidly attached to shank 24 at a location to inhibit the sliding of handle 22 towards the distal end of shank 24. Stop 20 is formed with a bearing surface in contact with the end bearing surface of handle 22, to allow axial rotation about shank 24. A bit socket 18 used to hold a tool bit 40 can be interchanged with stop 20 as shown in FIG. 2 to provide the same function.

Figure 6:
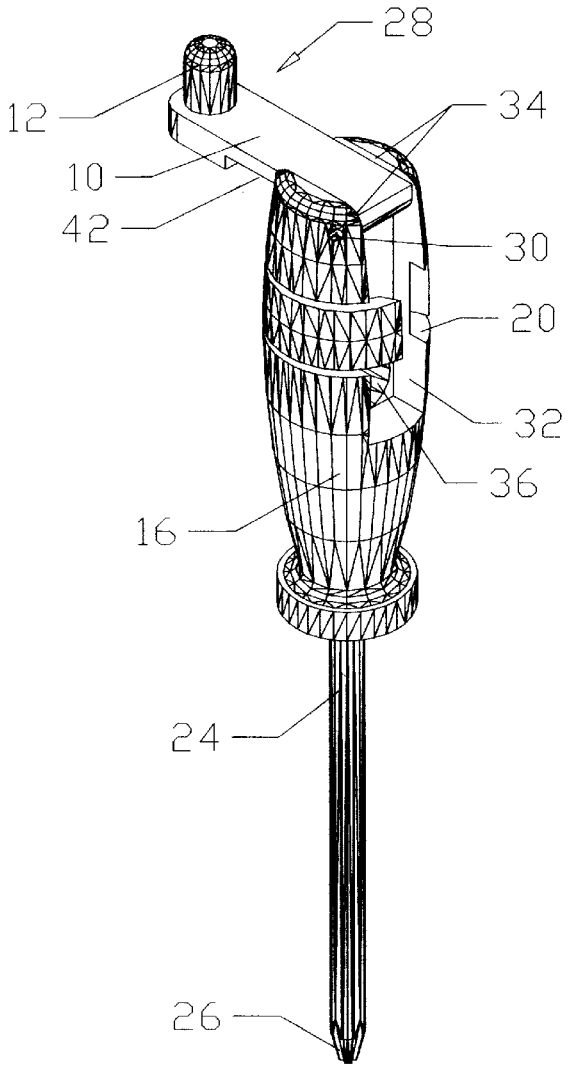
Figure 7:
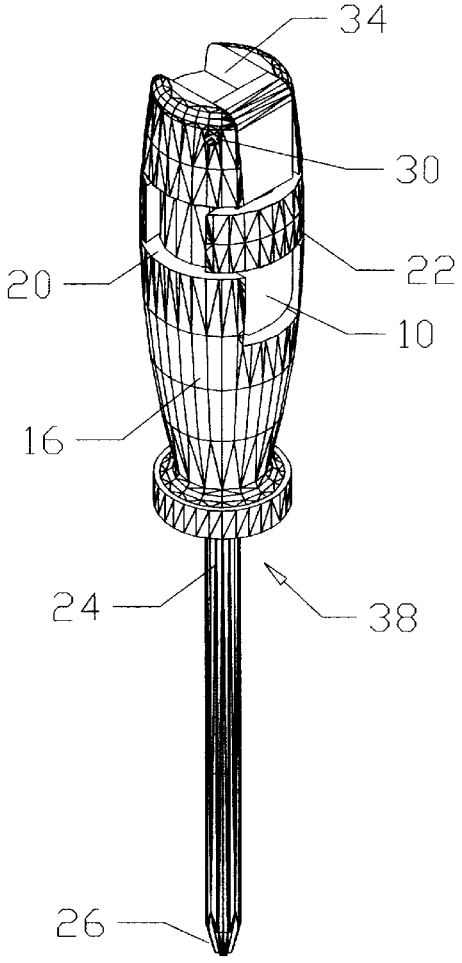

In FIGS. 6 & 7, a C-shaped secondary handle 22 having a cylindrical inner bearing surface and a bearing surface at each end, is mounted coaxial with shank 24. The inner bearing surface of handle 22 is in contact with a cylindrical outer surface of handle 16 coaxial with shank 24. Therefore, handle 22 can freely rotate axially about shank 24, and slide along the longitudinal axis of shank 24. A bearing stop 20 is formed into handle 22 to inhibit the sliding of handle 22 towards the distal end of shank 24. Stop 20 is also constructed with a bearing surface in contact with the bearing surface of handle 22, to allow handle 22 axial rotation about shank 24. A notch 42 is formed into arm 10 to allow handle 22 to freely rotate axially about shank 24 when assembly 28 is in the stored position (FIG. 7).

Figure 9:
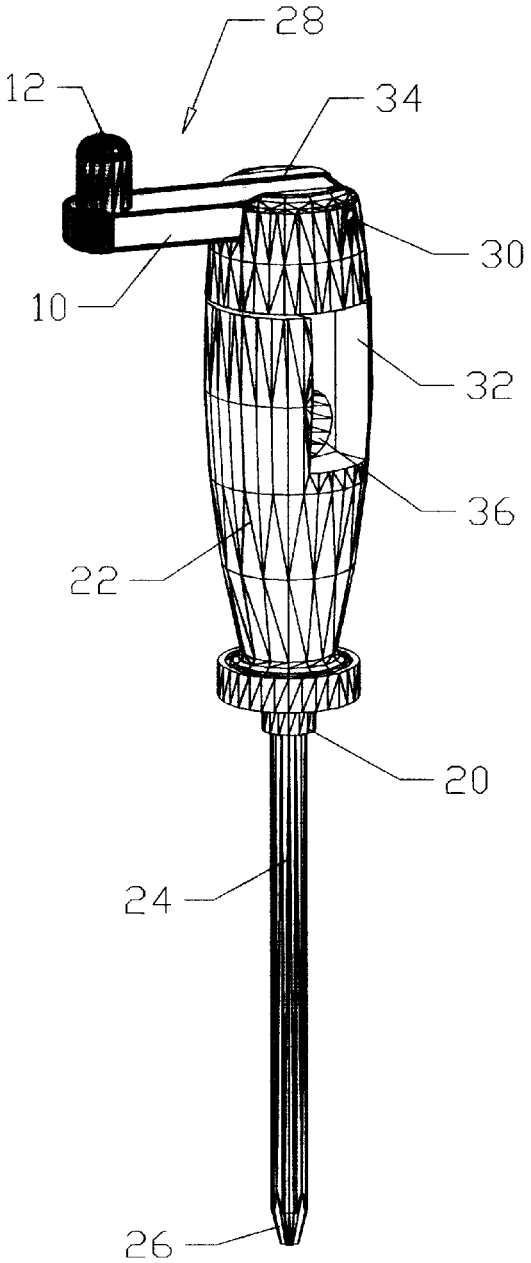
FIG. 9 shows a another embodiment of the rotary driver with the crank arm assembly in the working position.
Figure 8:
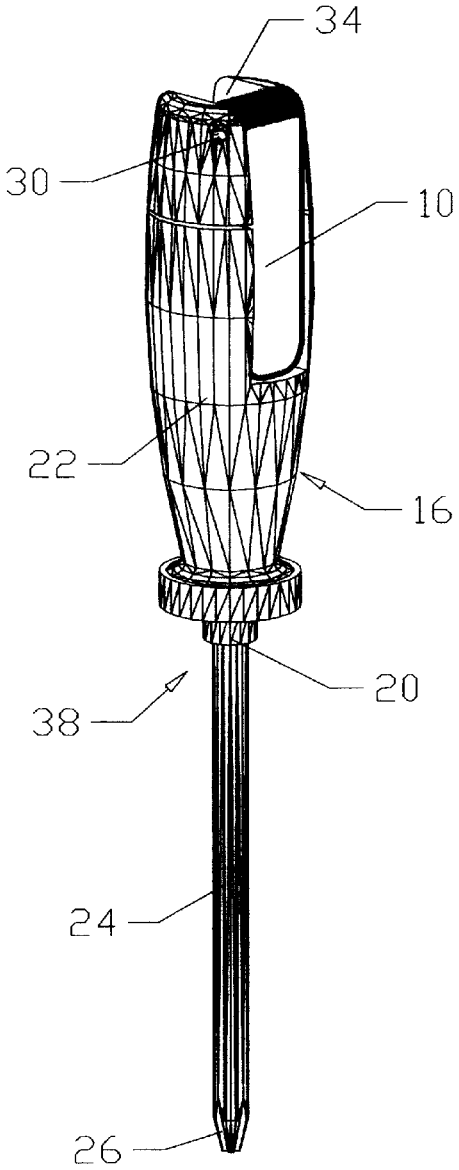
FIG. 8 shows a embodiment of the rotary driver with the crank arm assembly in the stored position, locking both handle sections together.

In FIGS. 8 & 9, a common screwdriver handle shaped handle 22 having a cylindrical inner bearing surface and a bearing surface at its shaft end, is mounted coaxial with shank 24. The inner bearing surface of handle 22 is in contact with the cylindrical outer surface of shank 24. Therefore, handle 22 can freely rotate axially about shank 24, and freely slide along the longitudinal axis of shank 24. A bearing stop 20 is rigidly attached to shank 24 at a location to inhibit the sliding of handle 22 towards the distal end of shank 24. Stop 20 is formed with a bearing surface in contact with the end bearing surface of handle 22, to allow axial rotation about shank 24. Handle 22 has part of the storage pockets 32 & 36 in it, providing a detent for axial rotation about shank 24 when assembly 28 is rotated to the stored position (FIG. 8). In this position, the rotary driver has the feel and function of a traditional screwdriver.

While the embodiments described and illustrated are shown incorporated into a common screwdriver, it will be appreciated that many other screwdriver type hand tools such as ratcheting screwdrivers could be used.

OPERATION—FIGS. 1, 2, 3, 6, 7, 8, 9

The rotary driver is intended to be used with two hands, one on the secondary handle, and one on the lever arm handle located on the crank arm assembly. While applying force directed towards the fastener with the hand located on the secondary handle, the operator rotates the crank arm assembly about the tool's longitudinal axis (FIG. 3). The crank arm rotates the tool shank within the secondary handle, and therefore rotates the fastener. The bearing stop which by design inhibits the secondary handle from longitudinal travel, transmits the operator's applied force towards the tool bit. This maintains a good couple between the tool tip and the fastener.

The secondary handle also helps to stabilize the tool from the moment created from longitudinal forces acting towards the fastener from the crank arm, which tend to rotate the tool about the tool tip.

During the rotation of the rotary driver, the operators wrist on the cranking hand does not twist, providing a simple and non-fatiguing method of turning the rotary driver. The tool can be rotated rapidly to quickly drive the fastener. In these embodiments, the secondary handle and bearing stop designs play an integral role in the function of the rotary driver by allowing the user to provide a steady driving force towards the fastener with one hand, and rotational torque with the other. When the user wants a traditional working screwdriver, the crank arm assembly is merely rotated into its storage pocket.

PREFERRED OPERATIONS—FIGS. 3, 4 & 5

In a interesting twist, the rotary driver can also work well without the secondary handle and bearing stop. This is because in every fastening situation, there is in essence a bearing already available to use. It relates to the basic theory of how a fastener actually works. When the rotary driver is coupled to a rotary fastener, the fastener's threaded hole acts like a bearing, holding the fastener (and thus the tip end of the tool shank) in a controlled revolution about the axis of the fastener. With this benefit, the operator has only to lightly cup the tool along its longitudinal axis to stabilize it, and provide both the rotation and longitudinal force towards the fastener with the crank arm assembly. This method of operating the rotary driver greatly simplifies its construction. Again, when the user wants a traditional working screwdriver, the crank arm assembly is merely rotated into its storage pocket (FIG. 5).

Ramifications

Although the description above contains many specificities, these should not be construed as limiting the scope of the invention, but as merely providing illustrations of some of the presently preferred embodiments of the rotary driver. For example:

The secondary handle can be made in variety of different shapes and sizes and materials to provide a comfortable, non-slip grip on the rotary driver. It can be made from bearing type materials including: plastics, metals, lubricated metals or plastics; that would provide smooth operation against the tool within. The secondary handle could also be located anywhere on the longitudinal axis of the rotary driver.

The bearing stop that transmits the driving force towards the fastener can be designed in a variety of different ways. It can be placed in front of the shaft bearing handle in many different forms, including: a shank collar, tool tip, bit socket, forged or pinched area, machined surface in the tool shank, etc. It could also be incorporated behind the secondary handle with a means of coupling the secondary handle with the bearing stop to provide a pulling type force against the bearing stop.

The crank arm assembly can be pivoted or slid into the working position from many different locations, especially when designing a handle mold. It can be directly or indirectly attached to the tool shank. It can be detented in many different ways, including ball plungers, snap fits, molded clasps and latches. It could also be molded right into the actual handle of the tool without the use of a specific lever arm, by making the diameter of the handle's back surface large enough to attach the lever arm handle to a point radial out from the tool shank. In another possible embodiment, the crank arm assembly could be made to slip on, over, or into a traditional screwdriver handle, providing a simple means to convert existing screwdriver into the unique rotary driver described within.

The crank arm assembly can be designed in many different ways including: lever arm handles of many different sizes and shapes, materials, different lever arm shapes, sizes and distances from the longitudinal axis of the invention, ect. The lever arm handle, for example, could be knurled, rubber coated metal or plastic to provide better grip, shaped ergonomically to provides a comfortable non-fatiguing grip, and located at a distance from the tool shank that provides a continuous, smooth, and balanced rotation.

Thus it is to be understood that various modifications can be made without departing from the spirit or scope of this invention as defined in the claims appended hereto.

I claim:

1. A manually rotated hand tool employed to drive threaded style rotary fasteners, comprising: a shaft having an engaging distal end to couple with said fasteners, an opposite end retained in a gripable handle that provides said shaft with increased rotational torque, said handle having a continuous rotating means, wherein the handle further includes a storage pocket positioned along its longitudinal axis and end, having adequate dimensions to store an operating crank, said crank having one end pivotably mounted within the end of said pocket, said mounting located so the crank can be rotated from a non-working position within the pocket, to a detented working position where a operating knob of the crank is at a given distance from said axis, such that the hand tool can be operated in either a conventional or continuous fashion when driving a fastener.

2. The hand tool of claim 1, wherein the tool further includes a contained gripable secondary handle having a inner bearing surface coaxial with an outer bearing surface on the tool's longitudinal axis, allowing said secondary handle to freely rotate and slide about said surface within said containment having a bearing surface on at least one contained end, so a coupling force acting towards the fastener can be applied during tool rotation.

3. The hand tool of claim 1, wherein said handle has a generally round, ergonomic shape.

4. The hand tool of claim 1, wherein said crank pivots about 270 degrees.

5. The hand tool of claim 1, wherein said crank has a free spinning operating knob for a handle.

6. A hand tool comprising: a means for rotating a tool shank about its longitudinal axis in a uninterrupted continuous manner, a means for controllably coupling said hand tool to a threaded fastener, whereby said hand tool can be efficiently coupled and rotated to drive a rotary fastener, wherein said coupling means is a force produced by an operator urging a gripable secondary handle with a inner bearing surface coaxial with said axis, an end bearing surface on at least one end, having said handle contained within the tool; so that said force is transmitted towards the fastener through the tool shank to the fastener, wherein said rotating means is a pivotably mounted crank arm connected to said shank, producing a torque about the tool axis when rotated by an operator, wherein said handle includes a storage cavity positioned along its longitudinal axis, having adequate dimensions to store a portion of said operating crank, said mounting located so the crank can be rotated from a detented working position to a non-working position within said cavity, preventing any coaxial rotation of handle with respect to the shank, allowing the tool to be operated in either a conventional or continuous fashion when driving a fastener.

7. A hand tool comprising: a means for rotating a tool shank about its longitudinal axis in a uninterrupted continuous manner, a means for controllably coupling said hand tool to a threaded fastener, whereby said hand tool can be efficiently coupled and rotated to drive a rotary fastener, wherein said coupling means is a force produced by an operator urging a gripable secondary handle with a inner bearing surface coaxial with said axis, an end bearing surface on at least one end, having said handle contained within the tool; towards the fastener so that said force is transmitted through the tool shank to the fastener, wherein said rotating means is a pivotably mounted crank arm connected to said shank, producing a torque about the tool axis when rotated by an operator, wherein said crank arm pivots approximately 270 degrees.

8. A hand tool comprising: a means for rotating a tool shank about its longitudinal axis in a uninterrupted continuous manner, a means for controllably coupling said hand tool to a threaded fastener, wherein said rotating means is a pivotably mounted crank arm connected to said shank, producing a torque about the tool axis when rotated by an operator, whereby said hand tool can be efficiently coupled and rotated to drive a rotary fastener.

* * * * *